US009469903B2

(12) United States Patent
Smith et al.

(10) Patent No.: US 9,469,903 B2
(45) Date of Patent: Oct. 18, 2016

(54) MILDLY ALKALINE THIN INORGANIC CORROSION PROTECTIVE COATING FOR METAL SUBSTRATES

(75) Inventors: Thomas S. Smith, Novi, MI (US); Jasdeep Sohi, Shelby Township, MI (US); Brian D. Bammel, Rochester Hills, MI (US); Gregory T. Donaldson, Sterling Heights, MI (US); John J. Comoford, Royal Oak, MI (US); John McGee, Troy, MI (US); John L. Zimmerman, Taylor, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/297,962

(22) Filed: Nov. 16, 2011

(65) Prior Publication Data

US 2012/0121929 A1 May 17, 2012

Related U.S. Application Data

(63) Continuation of application No. PCT/US2009/065663, filed on Nov. 24, 2009, and a continuation-in-part of application No. PCT/US2009/044504, filed on May 19, 2009.

(60) Provisional application No. 61/054,363, filed on May 19, 2008.

(51) Int. Cl.

| | |
|---|---|
| ***B32B 15/04*** | (2006.01) |
| ***C23C 22/60*** | (2006.01) |
| ***C23C 22/66*** | (2006.01) |

(52) U.S. Cl.

CPC ..... *C23C 22/60* (2013.01); *C23C 22/66* (2013.01); *Y10T 428/1266* (2015.01); *Y10T 428/12493* (2015.01)

(58) Field of Classification Search

None

See application file for complete search history.

(56) References Cited

U.S. PATENT DOCUMENTS

| | | | | |
|---|---|---|---|---|
| 3,912,548 | A * | 10/1975 | Faigen | 428/472 |
| 3,955,935 | A | 5/1976 | Shockley et al. | |
| 4,024,294 | A | 5/1977 | Rairden | |
| 4,079,163 | A | 3/1978 | Tanaka et al. | |
| 4,173,685 | A | 11/1979 | Weatherly | |

(Continued)

FOREIGN PATENT DOCUMENTS

| | | | |
|---|---|---|---|
| CN | 101384751 | A | 3/2009 |
| EP | 2011900 | A1 | 4/2007 |

(Continued)

OTHER PUBLICATIONS

Odian, Principles of Polymerization, 1991, John Wiley & Sons, Third Ed., pp. 339-341.*

(Continued)

*Primary Examiner* — Elizabeth A. Robinson
*Assistant Examiner* — Daniel D Lowrey
(74) *Attorney, Agent, or Firm* — Mary K. Cameron

(57) ABSTRACT

Disclosed is a neutral to alkaline inorganic conversion coating composition that can be applied directly to a metal surface without a phosphatizing pre-treatment and that provides significant corrosion protection to the surface. The coating composition is very versatile and can accommodate addition of a wide variety of organic polymers which can be added directly to the coating composition thus eliminating multistep coating processes.

27 Claims, 5 Drawing Sheets

(56) References Cited

U.S. PATENT DOCUMENTS

| | | | | |
|---|---|---|---|---|
| 4,220,485 | A | 9/1980 | Howell et al. | |
| 4,244,878 | A | 1/1981 | McDermott | |
| 4,328,285 | A | 5/1982 | Siemers et al. | |
| 4,371,589 | A | 2/1983 | Warner et al. | |
| 4,411,964 | A | 10/1983 | Hara et al. | |
| 4,522,844 | A | 6/1985 | Khanna et al. | |
| 4,524,111 | A | 6/1985 | Oka et al. | |
| 4,556,098 | A | 12/1985 | Hintermann et al. | |
| 4,713,112 | A | 12/1987 | Barre et al. | |
| 4,731,301 | A | 3/1988 | Higuchi et al. | |
| 4,793,968 | A | 12/1988 | Mosser et al. | |
| 4,820,591 | A | 4/1989 | Ramanarayanan | |
| 4,822,415 | A | 4/1989 | Dorfman et al. | |
| 4,844,753 | A * | 7/1989 | Katayama et al. | 148/251 |
| 4,891,274 | A | 1/1990 | Higuchi et al. | |
| 4,954,372 | A | 9/1990 | Sako et al. | |
| 4,965,088 | A | 10/1990 | Shimamune et al. | |
| 5,030,517 | A | 7/1991 | Gilman et al. | |
| 5,035,958 | A | 7/1991 | Jackson et al. | |
| 5,043,138 | A | 8/1991 | Darolia et al. | |
| 5,135,780 | A * | 8/1992 | Kissel | 427/404 |
| 5,252,360 | A | 10/1993 | Huttl et al. | |
| 5,322,560 | A | 6/1994 | DePue et al. | |
| 5,340,448 | A | 8/1994 | Sekhar et al. | |
| 5,344,867 | A | 9/1994 | Morgan et al. | |
| 5,364,513 | A | 11/1994 | Sekhar et al. | |
| 5,578,238 | A | 11/1996 | Weiss et al. | |
| 5,624,749 | A * | 4/1997 | Kobayashi et al. | 428/341 |
| 5,637,422 | A | 6/1997 | Edamoto et al. | |
| 5,753,316 | A | 5/1998 | Brent et al. | |
| 5,783,545 | A | 7/1998 | Paatz et al. | |
| 5,858,544 | A | 1/1999 | Holl et al. | |
| 5,888,954 | A | 3/1999 | Haerer et al. | |
| 5,993,567 | A | 11/1999 | Dolan | |
| 6,001,236 | A | 12/1999 | de Nora et al. | |
| 6,027,579 | A | 2/2000 | Das et al. | |
| 6,076,264 | A | 6/2000 | Meckel | |
| 6,083,309 | A * | 7/2000 | Tomlinson | 106/14.21 |
| 6,153,080 | A | 11/2000 | Heimann et al. | |
| 6,165,257 | A | 12/2000 | Heimann et al. | |
| 6,171,704 | B1 | 1/2001 | Mosser et al. | |
| 6,190,779 | B1 | 2/2001 | Heimann et al. | |
| 6,248,181 | B1 * | 6/2001 | Osako et al. | 148/247 |
| 6,258,243 | B1 | 7/2001 | Heimann et al. | |
| 6,365,234 | B1 | 4/2002 | Schieferstein et al. | |
| 6,511,710 | B2 | 1/2003 | Warnecke | |
| 6,580,021 | B2 | 6/2003 | Barney | |
| 6,586,516 | B1 | 7/2003 | Kesselmayer et al. | |
| 6,610,185 | B2 | 8/2003 | Kim et al. | |
| 6,626,545 | B2 | 9/2003 | Gardner et al. | |
| 6,726,957 | B2 | 4/2004 | Niemiec | |
| 6,756,459 | B2 | 6/2004 | Larson et al. | |
| 7,008,979 | B2 | 3/2006 | Schottman et al. | |
| 7,150,918 | B2 | 12/2006 | Brady | |
| 7,169,472 | B2 | 1/2007 | Raksha et al. | |
| 7,293,793 | B2 | 11/2007 | Miyata | |
| 7,989,075 | B2 | 8/2011 | Jin et al. | |
| 8,092,617 | B2 | 1/2012 | Kramer et al. | |
| 8,263,232 | B2 * | 9/2012 | Kimata et al. | 428/624 |
| 2003/0213533 | A1 | 11/2003 | Sako et al. | |
| 2004/0204516 | A1 * | 10/2004 | DeFord et al. | 524/2 |
| 2008/0160328 | A1 * | 7/2008 | Jaworowski et al. | 428/469 |
| 2008/0193662 | A1 | 8/2008 | Dornbusch | |
| 2008/0292894 | A1 | 11/2008 | Park et al. | |
| 2009/0092839 | A1 | 4/2009 | Boocock | |
| 2009/0142589 | A1 * | 6/2009 | Shoji et al. | 428/336 |
| 2009/0202859 | A1 | 8/2009 | Kimata et al. | |
| 2010/0062200 | A1 | 3/2010 | Domes et al. | |
| 2015/0056390 | A1 * | 2/2015 | Miyai | C23C 22/34 428/35.8 |

FOREIGN PATENT DOCUMENTS

| | | | |
|---|---|---|---|
| JP | 56136978 | | 10/1981 |
| JP | 2002030460 | | 1/2002 |
| JP | 2002030460 | A | 1/2002 |
| JP | 2002047577 | A | 2/2002 |
| JP | 2003253458 | A | 9/2003 |
| JP | 2005194627 | A | 7/2005 |
| JP | 2007069783 | A | 3/2007 |
| JP | 2007204847 | A | 8/2007 |
| JP | 2008081785 | A | 4/2008 |
| JP | 2009144208 | A | 7/2009 |
| KR | 2006133164 | A | 6/2005 |
| KR | 1020060073483 | A | 6/2006 |
| WO | 0192598 | A1 | 6/2001 |
| WO | 0186016 | A2 | 11/2001 |
| WO | 0192598 | A1 | 12/2001 |
| WO | 2007069783 | A1 | 6/2007 |
| WO | 2007123276 | A1 | 11/2007 |
| WO | WO 2007123276 | A1 * | 11/2007 |
| WO | 2008110480 | A1 | 9/2008 |
| WO | 2009004684 | A1 | 1/2009 |
| WO | 2009143144 | A1 | 11/2009 |

OTHER PUBLICATIONS

International Search Report, Dated Aug. 14, 2009, 3 Pages.

Information Offer, 8 Pages, Submitted Feb. 26, 2013 forwarded from Japanese Patent Office on Mar. 26, 2013.

International Search Report for PCT/US2009/065663 dated Feb. 3, 2010. All references cited in the International Search Report are either cited herein, were previously cited in an IDS, or were previously cited by the Examiner.

Japanese Information Offer dated Jul. 24, 2015 from corresponding JP application 2012-511800, with English translation. All references cited in the Japanese Information Offer are cited herein.

* cited by examiner

MILDLY ALKALINE THIN INORGANIC CORROSION PROTECTIVE COATING FOR METAL SUBSTRATES

RELATED APPLICATIONS

This application is a continuation of prior application no. PCT/US2009/065663, with international filing date Nov. 24, 2009, which is a continuation-in-part of prior application no. PCT/US2009/044504 with international filing date May 19, 2009, which claims the benefit of U.S. Provisional Application No. 61/054,363 filed on May 19, 2008.

STATEMENT REGARDING FEDERALLY SPONSORED RESEARCH

None

TECHNICAL FIELD

This invention relates generally to corrosion protection of metal substrates, more particularly to a neutral to mildly alkaline thin inorganic dried in place coating composition that can be applied directly to a metal substrate without pre-treatment such as a phosphatizing solution and that provides enhanced corrosion protection to the metal substrate. The dried in place coatings of the present invention also provide a unique morphology when dried in place comprising a continuous inorganic phase and a discontinuous dispersed polymer phase.

BACKGROUND OF THE INVENTION

Untreated metal surfaces are subject to corrosion which can lead to rust development, weakening, discoloration and failure of the surface. Thus metal substrates are typically treated by a variety of methods to make the surface less reactive and more corrosion resistant. In addition, metal surfaces are often subsequently coated with decorative or additional protective coatings such as resin coatings, primers, paints and other surface treatments. Often the initial treatment of the metal surface involves a metal phosphate treatment followed by a chrome-containing rinse.

Metal objects to which surface treatments and coatings are applied can be grouped into several categories. In some industrial applications, the metal is formed into a 3-dimensional object after which any combination of surface treatments and or coating applications may be made. In a second category of industrial applications, surface treatments and or coatings are applied to the metal prior to forming when the metal is in the form of a flat sheet which is typically rolled into a coil. For many coatings applications within this category, special properties are desirable to facilitate rolling and forming operations. For coatings such as organic passivates, it may be desirable to have a high degree of hardness and block-resistance to facilitate rolling, however conventional coatings of high hardness frequently possess poor forming properties in that the integrity of the coating and ultimately its corrosion resistance is compromised by forming operations. It is desirable to provide coatings which have both high hardness and good forming properties.

It would be beneficial to develop a corrosion resistant coating composition that was inorganic and that could be used under neutral or mildly alkaline conditions. It is also important to provide a coating composition that would not prevent continued use of the other decorative surface treatments that have been used in the past. For many years coatings for metal such as organic passivate coatings have utilized hexavalent chrome stemming from its ability to inhibit corrosion. Hexavalent chrome has become less favored in the marketplace due to environmental considerations. Over time, trivalent chrome containing coatings have found greater use due to the lower level of environmental concern relative to hexavalent chrome based products. In many cases, this change has been made with a drop in corrosion resistance. It is always desirable to improve the performance properties of coatings such as corrosion resistance. This is true for any coating such as coatings based on hexavalent chrome. It would be more desirable to similarly improve performance properties such as corrosion resistance for coatings which are not based on hexavalent chrome, such as those based on trivalent chrome or non-chrome based coatings. It is also undesirable for coatings comprising chrome to leach chrome to the environment

SUMMARY OF THE INVENTION

In general terms, this invention provides a neutral or mildly alkaline inorganic coating composition that can be applied directly to a metal surface without a phosphatizing pre-treatment and that provides significant corrosion protection. Coatings of the present invention also provide a unique morphology when dried in place of two distinct phases. The first phase is a continuous inorganic phase derived from water-soluble inorganic components. The second phase is a dispersed phase comprising a polymer dispersion in the first phase. This morphology provides a number of desirable coating attributes. Such attributes include good forming properties despite high apparent hardness, outstanding adhesion to metals and alloys such as those based on iron, zinc and aluminum, and high chemical and corrosion resistance. Embodiments of the present invention which further comprise chrome are not prone to chrome leaching and show significant enhancements in corrosion resistance relative to conventional chrome based products.

The coating compositions prepared according to the present invention preferably have a pH of from about 6 to 11 and more preferably from 8 to 10. In one embodiment, a coating composition of the present invention comprises a source of at least one of the group IVB transition metal elements of the Periodic Table, namely zirconium, titanium, and hafnium and, optionally, a source of at least one of the group VB transition metal elements of the Periodic Table, namely vanadium, niobium, and tantalum. Preferably, the coating composition includes from 9 to 73% by weight, based on the total dry solids coating weight, of at least one element from group IVB of the Periodic Table. A preferred group IVB element is zirconium, preferably supplied as ammonium zirconium carbonate. A preferred group VB element is vanadium supplied as $V_2O_5$. The coating composition also includes an organic polymer wherein the weight percentage of organic polymer active solids based on total dry solids coating weight is from 1% to 75%.

In another embodiment, a coating composition of the present invention comprises a source of at least one of the group IVB transition metal elements of the Periodic Table, namely zirconium, titanium, and hafnium and a source of chrome. Preferably, the coating composition includes from 9 to 73% by weight, based on total dry solids coating weight, of at least one element from group IVB of the Periodic Table. A preferred group IVB element is zirconium, preferably supplied as ammonium zirconium carbonate. In this embodiment, the coating composition includes a chrome source such as chromium trioxide. The coating composition also includes an organic polymer wherein the weight percentage of organic polymer active solids based on total dry solids coating weight is from 1% to 75%.

The coating compositions according to the present invention are dry in place conversion coatings. The coating is very versatile because it can accommodate addition of a wide variety of organic polymers which can be added directly to the coating composition thus eliminating multistep coating processes, the suitable resin polymers being ones that are dispersible or soluble in the inorganic aqueous coating composition. In addition, the coating exhibits significant formability and hardness. Being a conversion coating, as the term is known in the art, components within the coating composition react with the metal substrate during the coating process to produce the final dry in place coating.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1A:
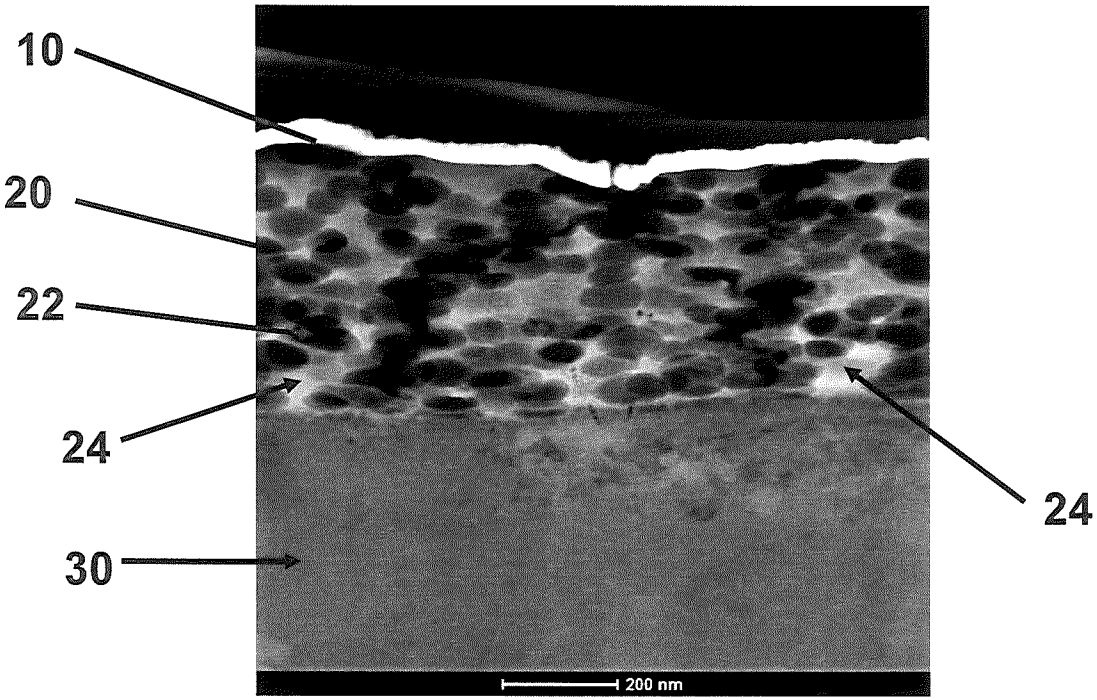
FIG. 1A is a photograph from a Dark-Field Scanning Transmission Electron Microscopy of a chrome-based coating prepared according to the present invention.

The present invention is directed toward treatment of bare metal surfaces meaning that the metal surface has not been pre-treated with any metal phosphate solutions, chrome-containing rinses, or any other passivating treatments. Metal surfaces that benefit from the process of the present invention include steel, cold rolled steel, hot rolled steel, stainless steel, aluminum, steel coated with zinc metal or zinc alloys such as electrogalvanized steel, Galvalume® the trademark name for 55% aluminum-zinc alloy coated sheet steel from U.S. Steel Corp., galvanneal, and hot-dipped galvanized steel.

Preferably, the metal surface has been cleaned and degreased prior to treatment according to the present invention. Cleaning of metal surfaces is well known in the art and can include mild or strongly alkaline cleaners. Examples of two alkaline cleaners include Parco® Cleaner ZX-1 and Parco® Cleaner 315 both available from Henkel Surface Technologies. Following cleaning the surface is preferably rinsed with water prior to treatment according to the present invention.

In one embodiment, the corrosion protection coating of the present invention comprises a mixture of at least one group IVB element and at least one group VB element in deionized water at a pH of from about 6 to 11 and more preferably at a pH of from 8 to 10. It is important that the pH of the composition be kept in this range for the coating process to work. In one embodiment, preferably the group IVB element is present in an amount of from about 1 to 7% by weight, more preferably from about 2 to 5% by weight and most preferably from 3 to 5% by weight of the composition based on the total weight of the composition. The coating composition can include any sub-range between 1 to 7% by weight based on the total weight. In this embodiment, preferably the amount of group VB element in the composition is from about 0.20 to 2.00% by weight and more preferably from about 0.40 to 1.00% by weight based on the total weight of the composition. The coating composition can include any sub-range between 0.20 to 2.00% by weight based on the total weight. Preferably the coating composition is a mixture of zirconium and vanadium. One preferred source of zirconium is ammonium zirconium carbonate called Bacote 20® and available from MEI in Flemington New Jersey. According to the literature from MEI, Bacote 20® is a clear, aqueous alkaline solution of stabilized ammonium zirconium carbonate containing anionic hydroxylated zirconium polymers. It provides approximately 20% w/w of $ZrO_2$. It is sold as a crosslinking agent for paper and paperboard applications. The preferred group VB element is vanadium provided as $V_2O_5$. Optionally, the present coating can further accommodate the addition of organic coating resin polymers of a variety of types including, by way of example only: epoxies, polyvinyl dichlorides, acrylic-based resins, methacrylate-based resins, styrene-based resins, polyurethane dispersions, and polyurethane dispersion hybrids. Examples of these resin polymers include Carboset® CR760, Hauthane HD-2120, Hauthane L-2989, Maincote™ PR-15, Maincote™ PR-71, Avanse® MV-100 an acrylic latex polymer, Rhoplex AC 337N, and Alberdingk-Boley LV-51136 and M-2959. The coating can also accommodate addition of reducing agents for the $V_2O_5$ such as cysteine, $Sn^{2+}$, ascorbic acid, or thiosuccinic acid. Optionally, one could initially start with $V^{+4}$ from vanadyl sulfate or vanadyl acetylacetonate. Optionally, the coating can also include processing aids such as waxes which aid in formability of the coated substrates. Addition of these optional agents will be discussed further below.

In a first example an inorganic coating composition according to the present invention was prepared by combining 83.00% by weight deionized (DI) water with 1.00% by weight $V_2O_5$ and 16.00% by weight of Bacote 20®. This level of Bacote 20® provides 3.2% by weight of $ZrO_2$ to the composition. The composition pH was approximately 9.5. The inorganic coating was applied to a series of hot-dipped galvanized (HDG) panels known as ACT HDG panels APR 31893 and U.S. Steel Corp. (USS) Galvalume® panels using the known technique of a draw wire to apply a coating weight of 200 milligrams per square foot (200 milligrams per 929.03 square centimeters). Galvalume® is the trademark name for 55% aluminum-zinc alloy coated sheet steel. Once applied the coating was dried in place to a Peak Metal Temperature (PMT) of 210° F. (98° C.) on the test panels. The panels were then subjected to a Neutral Salt Spray (NSS) corrosion test using method ASTM B117-03 with multiple panels for each time point. In this testing, uncoated panels of either HDG or USS Galvalume® showed 100% corrosion with in 24 hours in the NSS test. The test results for the average percent corrosion for each of the treated panels are shown below in Table 1.

TABLE 1

| | Time, hours (NSS) | | | | | | | |
|---|---|---|---|---|---|---|---|---|
| | 24 | 48 | 144 | 312 | 480 | 649 | 816 | 1008 |
| HDG | | 70.00 | | | | | | |
| USS Galvalume ® | 0.00 | 00.00 | 0.00 | 4.00 | 13.00 | 13.00 | 22.00 | 25.00 |

The results demonstrate the usefulness of the coating composition prepared according to the present invention. The coating composition of the present invention was very effective on USS Galvalume® steel providing significant corrosion protection out to 1008 hours as shown. These results are in dramatic difference to uncoated USS Galvalume® which was 100% corroded within 24 hours. The results were also significant, but not quite as good, using a HDG substrate.

As discussed above another advantage of the present coating composition is that it can easily accommodate the addition of organic resins to further enhance the corrosion protection without requiring complex multi-step processing or applications. The desired resin can merely be added to the coating composition. In a first example of combining the inorganic coating composition with an organic resin use was made of polyvinyl dichloride (PVDC) as the organic resin. The PVDC resin used was Noveon XPD-2903. A series of coating compositions were prepared as described below in Table 2.

TABLE 2

| Component | Formula 57B | Formula 57C | Formula 57D |
|---|---|---|---|
| Deionized water | 73.50 | 63.50 | 53.50 |
| Bacote 20 ® | 16.00 | 16.00 | 16.00 |
| $V_2O_5$ | 0.50 | 0.50 | 0.50 |
| PVDC | 10.00 | 20.00 | 30.00 |

Each formula was then coated onto a series of HDG panels and a series of USS Galvalume® panels using the dry in place process described above at a coating weight of 200 milligrams per square foot (200 milligrams per 929.03 square centimeters) and dried to a PMT of 210° F. (98° C.). A series of control HDG and USS Galvalume® panels were created using the commercially available non-chrome containing coating Granocoat® 342™ (G342) available from Henkel. The G342 was applied per the manufacture's instructions. In a first test panels were subjected to a NSS test as described above and multiples of each time point were evaluated for the percent corrosion and the average calculated. The results are presented below in Table 3 wherein the abbreviation Gal. indicates the USS Galvalume® panels.

TABLE 3

| Time hours (NSS) | G342 Gal. | 57B Gal. | 57C Gal. | 57D Gal. | G342 HDG | 57B HDG | 57C HDG | 57D HDG |
|---|---|---|---|---|---|---|---|---|
| 24 | 0.10 | 0.03 | 0.00 | 0.00 | 0.00 | 1.10 | 0.13 | 0.77 |
| 48 | 0.10 | 0.03 | 0.00 | 0.00 | 0.20 | 1.10 | 0.30 | 2.67 |
| 72 | 0.33 | 0.33 | 0.00 | 0.00 | 0.67 | 1.67 | 4.33 | 3.00 |
| 96 | 0.67 | 0.33 | 0.00 | 0.00 | 2.67 | 3.67 | 8.67 | 7.33 |
| 168 | 5.00 | 1.00 | 0.00 | 0.00 | 17.00 | 8.67 | 18.33 | 20.00 |
| 336 | 13.33 | 1.00 | 0.03 | 0.05 | 63.33 | 35.00 | 56.67 | 43.33 |
| 504 | 48.67 | 2.67 | 0.33 | 0.50 | | 60.00 | 75.00 | 70.00 |
| 672 | 76.67 | 2.67 | 2.33 | 1.00 | | | | |

TABLE 3-continued

| Time hours (NSS) | G342 Gal. | 57B Gal. | 57C Gal. | 57D Gal. | G342 HDG | 57B HDG | 57C HDG | 57D HDG |
|---|---|---|---|---|---|---|---|---|
| 840 | | 3.00 | 4.33 | 3.00 | | | | |
| 1200 | | 10.67 | 9.00 | 3.00 | | | | |

The results conclusively demonstrate the enhanced corrosion protection provided by the coating composition of the present invention. In viewing the data on the USS Galvalume® panels one begins to see an improvement in corrosion protection in all of the panels compared to the G342 control by 168 hours of testing and the differences increase with increased testing time. After 504 hours of testing the panels coated according to the present invention have from 18 to 147 fold less corrosion than the control G342 panels. By 840 hours the control G342 panels have from 28 to 76 times as much corrosion as the panels coated according to the present invention. Even after 1200 hours of testing the panels coated according to the present invention have only 3 to 11% corrosion. These results are dramatic and show the power of the coating composition prepared according to the present invention. The results also demonstrate that increasing the level of polyvinyl dichloride from 10% to 30% had a small effect on the degree of corrosion protection at the last time point. Turning to data from the HDG panels one can see that coatings according to the present invention also provide enhanced protection compared to the G342 up to a point of about 504 hours. The results with the HDG panels are not as dramatic as for the USS Galvalume® panels. Also, the effect of increasing the level of polyvinyl dichloride seems to be the opposite of that seen on the USS Galvalume® panels. The higher the level of polyvinyl dichloride the worse the coating seemed to be in protecting from corrosion for the HDG panels.

In the next series of corrosion testing panels of USS Galvalume® or HDG were coated as described above using the formulas from Table 2 at 200 milligrams per square foot (200 milligrams per 929.03 square centimeters) and dried in place to a PMT of 210° F. (98° C.) onto the panels. Then a Stack Test was performed to simulate panels in contact with each other in a humid environment. The Stack Test was performed by spraying deionized water onto a coated side of a first panel, placing a coated side of a second panel against the coated side of the first panel and then clamping the first and second panels together. The clamped panels are then placed in a humidity test chamber at 100° F. (38° C.) and 100% humidity. After various time points multiples of each condition are removed and the percent corrosion of each is determined and the results averaged. The averaged results are presented below in Table 4.

TABLE 4

| Time hours (Stack) | G342 Gal. | 57B Gal. | 57C Gal. | 57D Gal. | G342 HDG | 57B HDG | 57C HDG | 57D HDG |
|---|---|---|---|---|---|---|---|---|
| 168 | 3.00 | 0.00 | 0.00 | 0.00 | 0.00 | 0.00 | 0.00 | 0.00 |
| 336 | 5.00 | 0.00 | 0.00 | 0.00 | 5.00 | 3.00 | 1.00 | 1.00 |
| 504 | 5.00 | 0.00 | 0.00 | 7.00 | 5.00 | 3.00 | 3.00 | 5.00 |
| 672 | 7.00 | 0.00 | 1.00 | 8.00 | 5.00 | 5.00 | 10.00 | 16.00 |
| 840 | 8.25 | 0.50 | 1.00 | 12.00 | 10.00 | 16.00 | 25.00 | 30.00 |
| 1200 | 10.00 | 2.00 | 3.00 | 12.00 | 50.00 | 40.00 | 60.00 | 60.00 |
| 1344 | 10.00 | 2.00 | 3.00 | 16.00 | | | | |
| 1512 | 10.00 | 2.00 | 3.00 | 20.00 | | | | |
| 1680 | 10.00 | 3.00 | 7.00 | 23.33 | | | | |

TABLE 4-continued

| Time hours (Stack) | G342 Gal. | 57B Gal. | 57C Gal. | 57D Gal. | G342 HDG | 57B HDG | 57C HDG | 57D HDG |
|---|---|---|---|---|---|---|---|---|
| 1848 | 20.00 | 5.00 | 7.00 | 30.00 | | | | |
| 2016 | 22.50 | 5.00 | 10.00 | 40.00 | | | | |

The results demonstrate that for resin levels of 10 and 20% the coating composition according to the present invention performed much better than the G342 coating at all time points by a factors of 16 to 2.2 fold depending on the time point. The coating having 30% PVDC, however, did not perform as well as the control G342 panels after 1200 hours and by 2016 hours it showed about twice as much corrosion as the control panel. The reason for this difference is unknown. With respect to the HDG panels the results show less difference between the control panels and the coatings according to the present invention. The panels all show significant corrosion protection out to 504 hours. Thereafter the coating compositions with 20 and 30% PVDC performed worse than the G342 panels and than the 10% PVDC panels.

In the next series of corrosion testing panels of USS Galvalume® or HDG were coated as described above using the formulas from Table 2 at 200 milligrams per square foot (200 milligrams per 929.03 square centimeters) and dried in place to a PMT of 210° F. (98° C.) onto the panels. Then a Cleveland humidity test (CHT) was performed on the panels using ASTM method D4585. The results are presented below in Table 5.

TABLE 5

| Time hours (CHT) | G342 Gal. | 57B Gal. | 57C Gal. | 57D Gal. | G342 HDG | 57B HDG | 57C HDG | 57D HDG |
|---|---|---|---|---|---|---|---|---|
| 168 | 0.00 | 0.00 | 0.00 | 0.00 | 0.00 | 0.00 | 0.00 | 0.00 |
| 336 | 7.00 | 3.00 | 0.00 | 0.00 | 7.00 | 3.00 | 0.00 | 0.00 |
| 504 | 7.00 | 3.00 | 0.00 | 0.00 | 10.00 | 3.00 | 0.00 | 0.00 |
| 672 | 7.00 | 3.00 | 0.00 | 0.00 | 10.00 | 3.00 | 0.00 | |
| 840 | 7.00 | 3.00 | 0.00 | 0.00 | 10.00 | 3.00 | 1.00 | |
| 1200 | 7.00 | 7.00 | 1.00 | 0.3 | 16.00 | 5.00 | 5.00 | |

The USS Galvalume® results demonstrate that coating composition of the present invention performs much better than the control G342 coating except for 1200 hours at 10% PVDC which is equivalent to the control G342. The results also clearly demonstrate that increasing the amount of PVDC has a very positive effect on the corrosion protection of the coating prepared according to the present invention. Similar results are seen on the HDG panels with the coating according to the present invention providing significantly enhanced corrosion protection compared to the G342. In addition, increasing the amount of PVDC seems to enhance the corrosion protection.

In the next series of corrosion testing panels of USS Galvalume® or HDG were coated as described above using the formulas from Table 2 at 200 milligrams per square foot (200 milligrams per 929.03 square centimeters) and dried in place to a PMT of 210° F. (98° C.) onto the panels. Then a Butler water immersion (BWI) test was performed on a series of the panels. Each test panel is supported and immersed in a tank of distilled water such that there is one half an inch of water below each panel and three quarters of an inch of water above each panel. The tanks with the panels are then placed in a humidity chamber set at 100% humidity and 100° F. (38° C.). Panels are removed at the selected time points and evaluated for the percent corrosion. The results are presented below in Table 6.

TABLE 6

| Time hours (BWI) | G342 Gal. | 57B Gal. | 57C Gal. | 57D Gal. | G342 HDG | 57B HDG | 57C HDG | 57D HDG |
|---|---|---|---|---|---|---|---|---|
| 168 | 0.00 | 0.00 | 1.00 | 0.00 | 0.00 | 1.00 | 0.00 | 0.00 |
| 336 | 0.00 | 0.00 | 1.00 | 1.00 | 16.00 | 1.00 | 0.00 | 1.00 |
| 504 | 0.00 | 0.00 | 1.00 | 1.00 | 50.00 | 1.00 | 0.00 | 3.00 |
| 672 | 3.00 | 0.00 | 1.00 | 1.00 | | 1.00 | 0.00 | 3.00 |
| 840 | 7.00 | 7.00 | 1.00 | 3.00 | | 7.00 | 7.00 | 7.00 |
| 1200 | 16.00 | 7.00 | 3.00 | 10.00 | | 25.00 | 16.00 | 10.00 |
| 1344 | 16.00 | 7.00 | 3.00 | 10.00 | | 25.00 | 16.00 | 16.00 |
| 1572 | 20.00 | 7.00 | 3.00 | 10.00 | | 30.00 | 16.00 | 16.00 |
| 1680 | 20.00 | 7.00 | 3.00 | 10.00 | | 30.00 | 20.00 | 20.00 |
| 1848 | 25.00 | 7.00 | 3.00 | 10.00 | | 30.00 | 20.00 | 25.00 |
| 2016 | 30.00 | 7.00 | 3.00 | 16.00 | | 40.00 | 30.00 | 40.00 |

The USS Galvalume® results demonstrate that the coatings prepared according to the present invention provide significantly more corrosion protection than the control G342 coating. The enhanced protection ranges from an approximately 2 fold to 10 fold increased corrosion resistance compared to G342. The effect of PVDC level on the corrosion protection appears complex and non-linear with the highest level appearing less efficient than levels of from 10 to 20% by weight. The HDG panels also show the benefit of the coatings according to the present invention versus G342. All of the panels coated according to the present invention showed enhanced corrosion protection compared to G342. Again the effect of PVDC level was complex and seemed to show best results with 20% PVDC.

As shown above an advantage of the present coating is that it can easily accommodate the addition of organic resins to further enhance the corrosion protection with out requiring complex multi-step processing or applications. The desired resin can merely be added to the coating composition. In a second example of combining the inorganic coating with an organic resin use was made of a thermoplastic styrene-acrylic copolymer emulsion, designated Carboset® CR-760, as the organic resin. The Carboset® CR-760 is available from Lubrizol Advanced Materials, Inc. of Cleveland Ohio. The Carboset® CR-760 has approximately 42% by weight solids. In additional coatings the Carboset® CR-760 was further combined with the PVDC used above. In additional formulations the coating composition also included a carnauba wax emulsion to enhance formability of the coating composition. The carnauba wax emulsion used was Michem® Lube 160 available from Michelman, Inc. of Cincinnati Ohio. A series of coating compositions were prepared as described below in Table 7. Each formula was then coated onto a series of HDG panels and a series of USS Galvalume® panels using the dry in place process described above at a coating weight of 175 to 180 milligrams per square foot (175 to 180 milligrams per 929.03 square centimeters) and dried to a PMT of 210° F. (98° C.). In a first corrosion test panels were subjected to a NSS test as described above and multiple panels of each time point were evaluated for the percent corrosion. The average results for each time point for the NSS test are presented below in Table 8. No samples for NSS for formula 162B were run. Additional panels were used to evaluate the coatings using the Butler water immersion test, the Cleveland humidity test, and the Stack Test each performed as described above. The results of these tests are present below in Tables 9, 10 and 11 respectively.

TABLE 7

| Component | 162A | 162B | 162C | 162D |
|---|---|---|---|---|
| Deionized water | 32.50 | 26.00 | 39.50 | 33.00 |
| Bacote 20 ® | 16.00 | 16.00 | 16.00 | 16.00 |
| $V_2O_5$ | 0.50 | 0.50 | 0.50 | 0.50 |
| Carboset ® CR760 | 51.00 | 51.00 | 26.00 | 26.00 |
| PVDC | | | 18.00 | 18.00 |
| Carnauba wax | | 6.50 | | 6.50 |

TABLE 8

| Time hours (NSS) | 162A Gal. | 162B Gal. | 162C Gal | 162D Gal. | 162A HDG | 162B HDG | 162C HDG | 162D HDG |
|---|---|---|---|---|---|---|---|---|
| 24 | 0.00 | 0.00 | 0.00 | 0.00 | 0.00 | | 7.00 | 7.00 |
| 48 | 0.00 | 0.00 | 0.00 | 0.00 | 23.66 | | 16.00 | 20.00 |
| 168 | 0.00 | 1.00 | 0.70 | 0.00 | 100.00 | | 86.67 | 93.33 |
| 336 | 0.00 | 3.33 | 8.67 | 0.00 | | | | |
| 504 | 1.00 | 5.67 | 6.00 | 0.00 | | | | |
| 672 | 1.00 | 8.67 | 10.00 | 0.00 | | | | |
| 840 | 1.00 | 8.67 | 10.00 | 1.00 | | | | |
| 1008 | 1.00 | 15.00 | 16.00 | 1.00 | | | | |
| 1176 | 1.00 | 20.00 | 25.00 | 5.00 | | | | |
| 1344 | 5.00 | 25.33 | 50.00 | 15.33 | | | | |
| 1512 | 5.67 | 28.67 | | 17.33 | | | | |
| 1680 | 6.33 | 30.00 | | 20.00 | | | | |
| 1848 | 6.33 | 23.33 | | 20.00 | | | | |
| 2016 | 6.33 | 36.67 | | 21.67 | | | | |

The USS Galvalume® results demonstrate that the coatings according to the present invention all were more effective than the G342 coating was in the results reported in Table 3 above. The coating with just Carboset® CR760 was very effective even out as far as 2016 hours. The comparison of formula 162A to 162B shows that addition of the carnauba wax to this formula appears to reduce the coating effectiveness as a corrosion protection coating. The results also show that combining the Carboset® CR760 with PVDC reduces the effectiveness of the coating composition compared to use of Carboset® CR760 alone, however, addition of the carnauba wax to the blend seems to enhance its effectiveness. None of the coatings appear to be very effective on the HDG samples and presence of carnauba wax or PVDC does not seem to affect the performance of Carboset® CR760 alone.

TABLE 9

| Time hours (BWI) | 162A Gal. | 162B Gal. | 162C Gal | 162D Gal. | 162A HDG | 162B HDG | 162C HDG | 162D HDG |
|---|---|---|---|---|---|---|---|---|
| 168 | 0.00 | 0.00 | 0.00 | 0.00 | 0.00 | 0.00 | 0.00 | 0.00 |
| 336 | 1.00 | 1.00 | 0.00 | 0.00 | 0.00 | 0.00 | 0.00 | 0.00 |
| 504 | 3.00 | 3.00 | 1.00 | 1.00 | 0.00 | 3.00 | 5.00 | 5.00 |
| 672 | 5.00 | 3.00 | 3.00 | 1.00 | 1.00 | 5.00 | 5.00 | 5.00 |
| 840 | 5.00 | 5.00 | 3.00 | 1.00 | 1.00 | 7.00 | 7.00 | 10.00 |
| 1008 | 5.00 | 5.00 | 5.00 | 1.00 | 1.00 | 7.00 | 7.00 | 16.00 |
| 1176 | 16.00 | 10.00 | 10.00 | 1.00 | 1.00 | 1.00 | 16.00 | 20.00 |
| 1344 | 16.00 | 16.00 | 16.00 | 3.00 | 3.00 | 7.00 | 20.00 | 20.00 |
| 1512 | 16.00 | 16.00 | 20.00 | 3.00 | 3.00 | 10.00 | 25.00 | 30.00 |
| 1680 | 16.00 | 16.00 | 30.00 | 5.00 | 7.00 | 30.00 | 30.00 | 30.00 |
| 1848 | 16.00 | 16.00 | 30.00 | 5.00 | 7.00 | 30.00 | 50.00 | 50.00 |
| 2016 | 16.00 | 16.00 | 40.00 | 5.00 | 7.00 | 40.00 | | |

The results with the USS Galvalume® panels demonstrate that with the exception of the blend of Carboset® CR760 and PVDC all of the coatings performed better than did G342 from Table 6. In the BWI test there was not a detrimental effect on performance for Carboset® CR760 alone. In contrast to the NSS test, the combination of Carboset® CR760 with PVDC and carnauba wax performed the best in the BWI test. Again as seen in the NSS test results there is a benefit to including the carnauba wax when combining the Carboset® CR760 with PVDC. The results with the HDG panels also show that all of the coatings prepared according to the present invention performed better than did G342 from Table 6. Significantly better performance was obtained with the Carboset® CR760 alone compared to addition of carnauba wax, PVDC, or carnauba wax and PVDC.

TABLE 10

| Time hours (CHT) | 162A Gal. | 162B Gal. | 162C Gal | 162D Gal. | 162A HDG | 162B HDG | 162C HDG | 162D HDG |
|---|---|---|---|---|---|---|---|---|
| 168 | 0.00 | 0.00 | 0.00 | 0.00 | 0.00 | 0.00 | 0.00 | 0.00 |
| 336 | 0.00 | 0.00 | 0.00 | 0.00 | 0.00 | 0.00 | 0.00 | 0.00 |
| 504 | 3.00 | 3.00 | 3.00 | 1.00 | 0.00 | 3.00 | 5.00 | 5.00 |
| 672 | 3.00 | 3.00 | 3.00 | 2.00 | 0.00 | 3.00 | 5.00 | 5.00 |
| 840 | 3.00 | 3.00 | 3.00 | 3.00 | 1.00 | 3.00 | 5.00 | 5.00 |
| 1008 | 3.00 | 3.00 | 3.00 | 3.00 | 3.00 | 3.00 | 5.00 | 5.00 |

The results for both the USS Galvalume® and HDG show that in the Cleveland humidity test all of the coatings according to the present invention performed equally well irrespective of the substrate and that all performed better than the results seen with the control G342 in Table 5.

TABLE 11

| Time hours (Stack) | 162A Gal. | 162B Gal. | 162C Gal | 162D Gal. | 162A HDG | 162B HDG | 162C HDG | 162D HDG |
|---|---|---|---|---|---|---|---|---|
| 168 | 0.00 | 0.00 | 0.00 | 0.00 | 0.00 | 0.00 | 0.00 | 0.00 |
| 336 | 0.00 | 1.00 | 0.00 | 0.00 | 0.00 | 0.00 | 1.00 | 1.00 |
| 504 | 0.00 | 1.00 | 1.00 | 1.00 | 5.00 | 5.00 | 10.00 | 7.00 |
| 672 | 0.00 | 3.00 | 1.00 | 1.00 | 10.00 | 20.00 | 30.00 | 16.00 |
| 840 | 1.00 | 5.00 | 1.00 | 3.00 | 10.00 | 20.00 | 30.00 | 37.50 |
| 1008 | 1.00 | 5.00 | 3.00 | 3.00 | 20.00 | 30.00 | 40.00 | 40.00 |
| 1176 | 1.00 | 5.00 | 3.00 | 5.00 | 30.00 | 40.00 | | |
| 1344 | 3.00 | 5.00 | 3.00 | 5.00 | 50.00 | | | |
| 1512 | 3.00 | 7.00 | 3.00 | 5.00 | | | | |
| 1680 | 3.00 | 7.00 | 3.00 | 5.00 | | | | |
| 1848 | 3.00 | 7.00 | 3.00 | 5.00 | | | | |
| 2016 | 5.00 | 7.00 | 5.00 | 5.00 | | | | |

The USS Galvalume® results demonstrate that all of the coatings according to the present invention performed equally well in the Stacks Test and that they performed better than the control G342 in Table 4. The HDG results were different, the Carboset® CR760 alone seemed to perform the best with the other coatings performing worse. None of the coatings seemed to perform much better than the G342 in Table 4.

In another series of tests the amount of ammonium zirconium carbonate in the coating was varied to vary the amount of $ZrO_2$ in the coating composition and the effect on corrosion protection was determined. The coating formulas are given below in Table 12. In addition, control panels were coated with G342 as described above. The coatings were applied to USS Galvalume® panels at a coating weight of approximately 200 milligrams per square foot (200 milligrams per 929.03 square centimeters) as described above and dried in place to a PMT of 210° F. (98° C.). The panels were then tested in the NSS, Butler water immersion test, and Stack Test and the results are given below in Tables 13, 14, and 15 respectively.

TABLE 12

| Component | 162A | 162B | 183A/F | 183E |
|---|---|---|---|---|
| Deionized water | 32.50 | 26.00 | 40.50 | 42.50 |
| Bacote 20 ® | 16.00 | 16.00 | 8.00 | 6.00 |
| $V_2O_5$ | 0.50 | 0.50 | 0.50 | 0.50 |
| Carboset ® CR760 | 51.00 | 51.00 | 51.00 | 51.00 |
| Carnauba wax | | 6.50 | | |

TABLE 13

| Time hours (NSS) | G342 | 162A | 162B | 183A/F | 183E |
|---|---|---|---|---|---|
| 24 | 0.00 | 0.00 | 0.00 | 0.00 | 0.00 |
| 72 | 0.00 | 0.00 | 0.00 | 0.00 | 0.00 |
| 168 | 3.00 | 0.00 | 0.00 | 0.00 | 1.00 |
| 336 | 31.67 | 0.00 | 0.00 | 3.83 | 21.67 |
| 504 | 60.00 | 0.00 | 1.00 | 31.00 | 80.00 |
| 672 | | 1.00 | 1.00 | 31.50 | |
| 840 | | 1.00 | 1.00 | 25.33 | |
| 1032 | | 1.00 | 1.00 | 35.33 | |
| 1172 | | 1.00 | 1.00 | 30.00 | |
| 1344 | | 1.67 | 3.00 | 40.00 | |
| 1560 | | 2.00 | 3.00 | 40.00 | |
| 1728 | | 4.00 | 5.00 | 50.00 | |

The results demonstrate that all of the coatings according to the present invention were at least as effective as G342 and most were much more effective. The results also demonstrate that increasing the level of $ZrO_2$ from 1.20% to 3.20% dramatically increased the effectiveness of the coatings prepared according to the present invention.

TABLE 14

| Time hours (BWI) | G342 | 162A | 162B | 183A/F | 183E |
|---|---|---|---|---|---|
| 168 | 0.00 | 0.00 | 0.00 | 0.00 | 0.00 |
| 336 | 0.00 | 0.00 | 0.00 | 0.00 | 0.00 |
| 504 | 0.00 | 0.00 | 1.00 | 0.00 | 1.00 |
| 672 | 0.00 | 1.00 | 3.00 | 0.50 | 3.00 |
| 840 | 0.00 | 3.00 | 3.00 | 0.50 | 3.00 |
| 1032 | 0.00 | 3.00 | 3.00 | 3.00 | 7.00 |
| 1176 | 10.00 | 5.00 | 5.00 | 4.00 | 10.00 |
| 1344 | 30.00 | 7.00 | 7.00 | 4.00 | 20.00 |
| 1512 | 50.00 | 7.00 | 7.00 | 5.00 | 20.00 |
| 1680 | | 1.00 | 1.00 | 3.00 | 20.00 |
| 1848 | | 3.00 | 3.00 | 5.00 | 20.00 |
| 2016 | | 5.00 | 5.00 | 7.5 | 20.00 |

The results again demonstrate that the coatings according to the present invention all perform much better than G342. In addition, although not as dramatic as for the NSS test, the results demonstrate that increasing the amount of $ZrO_2$ increases the effectiveness of the coating in corrosion protection.

TABLE 15

| Time hours (Stack) | G342 | 162A | 162B | 183A/F | 183E |
|---|---|---|---|---|---|
| 168 | 0.00 | 0.00 | 0.00 | 0.00 | 0.00 |
| 336 | 0.00 | 0.00 | 0.00 | 0.00 | 0.00 |
| 504 | 1.00 | 1.00 | 0.00 | 0.00 | 0.0 |
| 672 | 1.00 | 3.00 | 0.00 | 0.00 | 1.00 |
| 840 | 3.00 | 3.00 | 1.00 | 2.00 | 1.00 |
| 1032 | 3.00 | 3.00 | 3.00 | 2.00 | 1.00 |

TABLE 15-continued

| Time hours (Stack) | G342 | 162A | 162B | 183A/F | 183E |
|---|---|---|---|---|---|
| 1176 | 3.00 | 5.00 | 3.00 | 3.00 | 3.00 |
| 1344 | 5.00 | 5.00 | 5.00 | 3.00 | 3.00 |
| 1512 | 7.00 | 5.00 | 5.00 | 4.00 | 5.00 |
| 1680 | 10.00 | 5.00 | 5.00 | 5.00 | 5.00 |
| 1848 | 10.00 | 5.00 | 5.00 | 6.00 | 5.00 |
| 2016 | 10.00 | 5.00 | 7.00 | 13.00 | 7.00 |

The results also demonstrate that the coatings according to the present invention perform better than the control G342, however, there was not the same increase in effectiveness with increasing $ZrO_2$ as was seen in the other tests.

In the next series of experiments two additional resins 3272-096 and 3272-103 were prepared as detailed below and then these resins were used to create coatings according to the present invention as detailed in Table 16 below.

Resin 3272-096

The resin 3272-096 included as monomers: acetoacetoxyethyl methacrylate (AAEM), n-butyl methacrylate, styrene, methyl methacrylate, 2-ethylhexyl acrylate, and ADD APT PolySurf HP which is a mixture of methacrylated mono and di-phosphate ester. The total monomer distribution in the resin was as follows: 20.00% AAEM, 12.50% n-butyl methacrylate, 15.00% styrene, 27.50% methyl methacrylate, 20.00% 2-ethylhexyl acrylate, and 5.00% ADD APT PolySurf HP. The resin polymerization reaction was run under $N_2$ with stifling and a heat set point of 80° C. The initial charge to the reaction vessel was 241.10 grams of DI water, 2.62 grams of ammonium lauryl sulfate (Rhodapon L-22 EP), and 2.39 grams of ferrous sulfate 0.5% $FeSO_4 7H_2O$ (3 ppm). This initial charge was put into the reaction vessel at time zero and heating to the set point was begun. After 30 minutes a reactor seed comprising a combination of 5.73 grams of DI water, 0.90 grams of non-ionic surfactant (Tergitol 15-S-20), 0.13 grams of ammonium lauryl sulfate (Rhodapon L-22 EP), 2.15 grams of n-butyl methacrylate, 2.57 grams of styrene, 4.74 grams of methyl methacrylate, 3.48 grams of 2-ethylhexyl acrylate, 3.41 grams of acetoacetoxyethyl methacrylate (AAEM), and 0.85 grams of ADD APT PolySurf HP was added to the reaction vessel and heating to the set point was continued for another 15 minutes. Then an initial initiator charge was added to the vessel comprising 0.32 grams of $HOCH_2SO_2Na$, 4.68 grams of DI water, 0.45 grams of tert-butylhydroperoxide, and an additional 4.54 grams of DI water and the temperature was maintained at the set point for another 30 minutes. Then the monomer and initiator co-feeds were added to the vessel over a three hour period with the temperature maintained at the set point. The monomer co-feed was 106.92 grams of DI water, 17.10 grams of Tergitol 15-S-20, 2.49 grams of Rhodapon L-22 EP, 40.89 grams of n-butyl methacrylate, 48.83 grams of styrene, 89.97 grams of methyl methacrylate, 66.10 grams of 2-ethylhexyl acrylate, 64.77 grams of AAEM, and 16.19 grams of ADD APT PolySurf HP. The initiator co-feed was 0.97 grams of $HOCH_2SO_2Na$, 14.03 grams of DI water, 1.39 grams of tert-butylhydroperoxide, and an additional 13.61 grams of DI water. After the three hours a chaser charge was added to the vessel over a 30 minute period. The chaser charge was 0.32 grams of $HOCH_2SO_2Na$, 4.88 grams of DI water, 0.46 grams of tert-butylhydroperoxide, and an additional 4.54 grams of DI water. The vessel was then held at the set point for one hour and 30 minutes. Then the cool down from the set point was begun and continued for 2 hours until the temperature was 38° C. Then the buffer co-feed was added to the vessel. The buffer co-feed was 5.19 grams of ammonium hydroxide (28%) and 18.48 grams of DI water. In this resin formation and that for 3272-103 detailed below another potential phosphate containing monomer that could be used in place of the ADD APT PolySurf HP is Ebecryl 168 from Radcure Corporation. Additional non-ionic surfactant stabilizers that could be used in place of Tergitol 15-S-20, which is a secondary alcohol ethoxylate, are other non-ionic stabilizers having a hydrophilic lipophilic balance of from 15 to 18. Examples of these stabilizers include: other secondary alcohol ethoxylates such as Tergitol 15-S-15; blends of ethoxylates such as Abex 2515; alkyl polyglycol ether such as Emulsogen LCN 118 or 258; tallow fatty alcohol ethoxylate such as Genapol T 200 and T 250; isotridecyl alcohol ethoxylates such as Genapol X 158 and X 250; tridecyl alcohol ethoxylates such as Rhodasurf BC-840; and oleyl alcohol ethoxylates such as Rhoadsurf ON-877.

Resin 3272-103

The organic coating resin 3272-103 was prepared as described below. The resin includes as monomers: acetoacetoxyethyl methacrylate (AAEM), n-butyl methacrylate, styrene, methyl methacrylate, 2-ethylhexyl acrylate, and ADD APT PolySurf HP which is a mixture of methacrylated mono and di-phosphate ester. The total monomer distribution in the resin was as follows: 20.00% AAEM, 12.50% n-butyl methacrylate, 15.00% styrene, 27.50% methyl methacrylate, 20.00% 2-ethylhexyl acrylate, and 5.00% ADD APT PolySurf HP. The resin polymerization reaction was run under $N_2$ with stirring and a heat set point of 80° C. The initial charge to the reaction vessel was 286.10 grams of DI water, 2.47 grams of Rhodapon L-22 EP. This initial charge was put into the reaction vessel at time zero and heating to the set point was begun. After 30 minutes a reactor seed comprising a combination of 5.44 grams of DI water, 0.85 grams of Tergitol 15-S-20, 0.12 grams of Rhodapon L-22 EP, 2.04 grams of n-butyl methacrylate, 2.44 grams of styrene, 4.49 grams of methyl methacrylate, 3.30 grams of 2-ethylhexyl acrylate, 3.24 grams of acetoacetoxyethyl methacrylate (AAEM), and 0.81 grams of ADD APT PolySurf HP was added to the reaction vessel and heating to the set point was continued for another 15 minutes. Then an initial initiator charge was added to the vessel comprising 4.79 grams of DI water and 0.21 grams of $(NH_4)_2S_2O_8$ and the temperature was maintained at 80° C. for another 30 minutes. Then the monomer and initiator co-feeds were added to the vessel over a three hour period with the temperature maintained at the set point. The monomer co-feed was 103.36 grams of DI water, 16.15 grams of Tergitol 15-S-20, 2.35 grams of Rhodapon L-22 EP, 38.81 grams of n-butyl methacrylate, 46.34 grams of styrene, 85.38 grams of methyl methacrylate, 62.73 grams of 2-ethylhexyl acrylate, 61.47 grams of AAEM, and 15.37 grams of ADD APT PolySurf HP. The initiator co-feed was 14.36 grams of DI water and 0.64 grams of $(NH_4)_2S_2O_8$. After the three hours a chaser charge was added to the vessel over a 30 minute period. The chaser charge was 0.35 grams of ascorbic acid, 4.65 grams of DI water, 0.44 grams of tert-butylhydroperoxide, an additional 4.56 grams of DI water, and 2.39 grams of ferrous sulfate 0.5% $FeSO_4 7H_2O$ (3 ppm). The vessel was then held at the set point for one hour and 30 minutes. Then the cool down was begun and continued for 2 hours until the temperature was 38° C. Then the buffer co-feed was added to the vessel. The buffer co-feed was 5.88 grams of ammonium hydroxide (28%) and 18.48 grams of DI water.

Taking the resins above a series of coatings were created to examine the effect of alkaline treatment on the coatings and the benefit of including $V_2O_5$ plus a reducing agent, cysteine, in the coating. Other reducing agents for the $V^{+5}$ could include $Sn^{+2}$, or ascorbic acid, or thiosuccinic acid, or one could start with $V^{+4}$ from vanadyl sulfate or vanadyl acetylacetonate. The coatings from Table 16 were then applied to HDG panels at a coating weight of approximately 200 milligrams per square foot (200 milligrams per 929.03 square centimeters) to each panel and then dried to a PMT of either 200° F. or 300° F. (93 or 149° C.) and either put directly into the NSS test or first washed with the alkaline cleaner PCl 338 and then put into the NSS test. A decrease in corrosion protection after pre-treatment with PCl 338 would indicate that the coatings were not alkaline resistant. The results of the NSS test are given in Table 17 below.

TABLE 16

| Component | 8A | 8H | 9A | 9H |
|---|---|---|---|---|
| Deionized water | 66.00 | 66.00 | 65.00 | 65.00 |
| Bacote 20 ® | 24.00 | 24.00 | 24.00 | 24.00 |
| $V_2O_5$ | | | 0.50 | 0.50 |
| Cysteine | | | 0.50 | 0.50 |
| 3272-096 | 10.00 | | 10.00 | |
| 3272-103 | | 10.00 | | 10.00 |

TABLE 17

| Treatment | Time hours (NSS) | 8A | 8H | 9A | 9H |
|---|---|---|---|---|---|
| PMT of 200° | 24 | 10.00 | 16.00 | 0.00 | 0.00 |
| F. (93° C.), no | 48 | 30.00 | 60.00 | 3.70 | 1.00 |
| treatment | 72 | 60.00 | | 8.70 | 1.00 |
| with PCl 338 | 96 | | | 11.30 | 43.00 |
| | 168 | | | 50.00 | 33.30 |
| | 336 | | | | 76.70 |
| PMT of 300 | 24 | 80.00 | 50.00 | 0.00 | 0.00 |
| F. (149° C.), | 48 | | | 0.00 | 1.00 |
| no treatment | 72 | | | 0.00 | 18.70 |
| with PCl 338 | 96 | | | 1.70 | 40.00 |
| | 168 | | | 50.00 | 65.30 |
| | 336 | | | | 93.30 |
| PMT 200° F. | 24 | 20.00 | 16.00 | 7.00 | 3.00 |
| (93° C.), pre- | 48 | 50.00 | 60.00 | 50.00 | 30.00 |
| treat with | 72 | 60.00 | | 50.00 | 50.00 |
| PCl 338 | 96 | | | 50.00 | |
| | 168 | | | 50.00 | |
| PMT of 300° | 24 | 80.00 | 50.00 | 3.00 | 0.00 |
| F. (149° C.), | 48 | | | 10.00 | 20.00 |
| pre-treat with | 72 | | | 80.00 | 50.00 |
| PCl 338 | | | | | |

The results demonstrate that for either resin the presence of $V_2O_5$ and cysteine was highly beneficial to the corrosion protection ability. Coatings prepared according to the present invention are designed to be applied directly to bare metal substrates without the need for any phosphate or other pre-treatments other than cleaning. They can be applied at any desired coating weight required by the situation, preferably they are applied at a coating weight of from 150 to 400 milligrams per square foot (150 to 400 milligrams per 929.03 square centimeters), more preferably at from 175 to 300 milligrams per square foot (175 to 300 milligrams per 929.03 square centimeters) and most preferably at from 175 to 250 milligrams per square foot (175 to 250 milligrams per 929.03 square centimeters). The coatings of the present invention are dry in place conversion coatings as known in the art and are preferably dried to a peak metal temperature of from 110 to 350° F. (43 to 177° C.), more preferably from 180 to 350° F. (82 to 177° C.), most preferably to a PMT of from 200 to 325° F. (93 to 163° C.).

Another series of coating compositions were prepared to demonstrate the need for elements both from group IVB and group VB. Initially a resin 3340-082 was created using the components below in Table 18 as described below.

TABLE 18

| Part | Material | Wt added gms |
|---|---|---|
| A | Deionized water | 245.3 |
| | Rhodapon L22 | 1.7 |
| B1 | Deionized water | 76.1 |
| | Rhodapon L22 | 1.7 |
| | Tergital 15-S-20 | 11.9 |
| B2 | n-butyl methacrylate | 28.6 |
| | Styrene | 34.1 |
| | Methyl methacrylate | 62.9 |
| | 2-ethylhexyl acrylate | 46.2 |
| | Acetoacetoxyethyl Methacrylate | 45.3 |
| | Polysurf HP | 11.3 |
| C | Ammonium persulfate | 0.60 |
| | Deionized water | 11.4 |
| D | 70% t-butylhydroperoxide | 0.31 |
| | Deionized water | 9.7 |
| E | Ascorbic acid | 0.17 |
| | Deionized water | 9.8 |
| F | 0.5% aqueous ferrous sulfate | 1.8 |
| G | Ammonium hydroxide 28.8% | 4.3 |
| | Deionized water | 10.5 |
| H | Deionized water | 14.4 |

Part A was added to a four-necked 3 liter flask equipped with a stirrer, a condenser, a thermocouple and a nitrogen inlet. The contents were heated to and maintained at 80° C. under nitrogen atmosphere. Parts B1 and B2 were mixed separately to form uniform clear compositions. B1 and B2 were mixed together to form pre-emulsion B. An amount of 5% of pre-emulsion B and 25% of part C were charged to the flask and maintained at 80° C. After 40 minutes the remainder of pre-emulsion B and part C were added at a constant rate to the flask over a period of 3 hours after which part H was used to flush the pre-emulsion addition pump into the flask. The flask contents were cooled to 70° C. at which time part F was added to the flask. Parts D and E were added to the flask over a period of 30 minutes, after which the mixture was maintained at 70° C. for a period of 1 hour. The mixture was then cooled to 40° C. at which time part G was added. The resulting latex had a solids content of 37.2%, a pH of 6.9, and particle size of 123 nanometers. A dihydropyridine function was then added to the resin to form resin 3340-83 by combining 300 parts by weight of resin 3340-082 with 0.79 parts by weight of propionaldehyde. The mixture was sealed in a container and placed in an oven at 40° C. for a period of 24 hours, thereby forming resin 3340-083. A series of coating compositions were prepared as described below in Table 19. Coating composition 164Q is the only one prepared in accordance with the present invention in that it includes elements from groups IVB and VB. Coating compositions 164R and 164S are missing the group IVB or VB elements respectively. Each coating composition was then applied to either HDG or Galvalume® (Gal) panels at a coating density of approximately 200 milligrams per square foot (200 milligrams per 929.03 centimeters) and dried to a peak metal temperature of 93° C. Multiple panels of each condition were then tested in the NSS test as described above and the average results for multiples at each time point and condition are reported below in Table 20.

TABLE 19

| Component | 164Q | 164R | 164S |
|---|---|---|---|
| DI Water | 62.85 | 83.95 | 63.35 |
| Bacote 20 | 24.0 | 0.0 | 24.0 |
| $(NH_4)_2CO_3$ | 0.0 | 2.9 | 0.0 |
| $V_2O_5$ | 0.5 | 0.5 | 0.0 |
| Resin 3340-083 | 12.15 | 12.15 | 12.15 |
| Cysteine | 0.5 | 0.5 | 0.5 |

TABLE 20

| Time hours (NSS) | 164Q Gal | 164R Gal | 164S Gal | 164Q HDG | 164R HDG | 164S HDG |
|---|---|---|---|---|---|---|
| 24 | 0 | 11.0 | 3.0 | 0.0 | 33.3 | 1.0 |
| 48 | 0 | 15.3 | 4.3 | 0.0 | 69.0 | 3.0 |
| 72 | 0 | 50.0 | 12.0 | 0.0 | 83.3 | 3.0 |
| 96 | | | | 0.0 | | 3.0 |
| 168 | 1.0 | | 25.0 | 0.3 | | 4.3 |
| 336 | 9.0 | | | 3.0 | | 50.0 |
| 504 | 10.0 | | | 10.0 | | |
| 672 | 12.0 | | | 43.3 | | |
| 840 | 12.0 | | | 83.3 | | |

The results shown in Table 20 clearly demonstrate the benefit of both IVB and VB elements in combination. With only one of the elements present the coating composition had minimal corrosion protection.

In another embodiment, coating compositions prepared according to the present invention comprise an inorganic portion comprising a source of at least one of the group IVB transition metal elements of the Periodic Table, namely zirconium, titanium, and hafnium and either at least one element of group VB of the Periodic Table or a source of chrome. The coating compositions further include an organic polymer. In this embodiment, preferably the coating composition includes from 9% to 73% by weight of the group IVB element based on the total dry solids coating weight. A preferred group IVB element is zirconium, preferably supplied as ammonium zirconium carbonate. In this embodiment, the coating composition also includes either a chrome source such as chromium trioxide or a group VB element such as vanadium, niobium, or tantalum. The coating composition according to this embodiment is also a dry in place conversion coating. The coating also includes at least one of a wide variety of resin organic polymers, which can be added directly to the coating composition thus eliminating multistep coating processes. Preferably, the weight percentage of organic polymer active solids based on total dry solids coating weight is from 1% to 75%, more preferably from 25% to 73% and most preferably from 40% to 70%. The resin organic polymers that can be included are of a variety of types including, by way of example only: epoxies, polyvinyl dichlorides, acrylic-based resins, methacrylate-based resins, styrene-based resins, polyurethane dispersions, and polyurethane dispersion hybrids. Examples of these resin polymers include Carboset® CR760, Hauthane HD-2120, Hauthane L-2989, Maincote™ PR-15, Maincote™ PR-71, Avanse® MV-100, Rhoplex AC 337N, and Alberdingk-Boley LV-51136 and M-2959. The coating can also accommodate addition of reducing agents such as cysteine, $Sn^{2+}$, ascorbic acid, or thiosuccinic acid and oxidation products thereof. Optionally, the coating composition can also include processing aids such as waxes which aid in formability of the coated substrates. Addition of these optional agents was discussed above. Being a conversion coating, as the term is known in the art, components within the coating composition react with the metal substrate during the coating process to produce the final dry in place coating.

Coating compositions prepared according to the present invention produce a dried in place coating having a unique morphology. The dried in place coating morphology produced has two phases, unexpectedly the inorganic portion of the coating compositions is the continuous phase while the discontinuous phase comprises the organic polymer. This is the opposite of conventional coatings and unexpected. A series of chrome-based coating compositions prepared according to the present invention and a series of comparative coating compositions were prepared according to the formulas given below in Table 21. The coating compositions were prepared by adding the components together in the order listed with mixing. All compositions were aged for 24 hours after mixing prior to use in the experiments described below. The Bacote® 20 serves as the source of the group IVB element in these examples. The weight percentage of organic polymer active solids based on total dry solids coating weight is preferably from 1% to 75%, more preferably from 25% to 73% and most preferably from 40% to 70%. The useful organic polymers have been described above in the previous examples. The organic polymer portion of all of the compositions in this example was the styrene-acrylic copolymer latex Carboset® CR760. The particle size of the latex was measured using laser light scattering measured by a Zetasizer 3000HSA available from Malvern Instruments. The average particle size was 111 nanometers with a range from 62 to 116 nanometers. The chrome content based on active coating solids of compositions 21A and 21B were the same as the chrome content of compositions 21C and 21D. In compositions 21B and 21D, the comparative examples, the Bacote® 20 was not used; however the calculated ammonium content from the Bacote® 20 was added using ammonia. Compositions 21A and 21B were a bright yellow in color consistent with a characteristic color of hexavalent chrome. By way of contrast compositions 21C and 21D, which include the reducing agent ascorbic acid, were a green-brown color consistent with a characteristic color of a predominantly trivalent chrome composition. Example 21A has a weight percentage of latex polymer active solids of 44% based on the total dry coating solids while it was 41% for example 21C. The weight percentage of group IVB element based on total dry coating solids was 37.00% for example 21A and 34.50% for example 21C.

TABLE 21

| Component | 21A | 21B | 21C | 21D |
|---|---|---|---|---|
| Deionized water | 65.45 | 73.85 | 64.70 | 74.10 |
| Bacote ® 20 | 24.00 | 0.00 | 24.00 | 0.00 |
| Ammonia (29% $NH_3$) | 0.00 | 4.15 | 0.00 | 4.15 |
| Chromium trioxide | 0.55 | 0.55 | 0.55 | 0.55 |
| Carboset ® CR760 | 10.00 | 21.45 | 10.00 | 19.70 |
| Ascorbic acid | 0.00 | 0.00 | 0.75 | 1.50 |
| Total | 100.00 | 100.00 | 100.00 | 100.00 |
| % Total active solids | 9.60 | 9.60 | 10.30 | 10.30 |

Another series of coatings was prepared using as the organic polymer another acrylic latex polymer Avanse® MV100 from Rohm and Haas. Again the compositions were prepared by mixing the components in the order of Table 22 and then each was aged for 24 hours prior to use.

The organic polymer portion of all of the compositions in this example was the latex Avanse® MV100. The particle size of the latex was measured using laser light scattering measured by a Zetasizer 3000HSA available from Malvern Instruments. The average particle size was 137 nanometers with a range from 90 to 207 nanometers. The chrome content based on active coating solids of compositions 22A and 22B were the same as the chrome content of compositions 22C and 22D. In compositions 22B and 22D, the comparative examples, the Bacote® 20 was not used; however the calculated ammonium content from the Bacote® 20 was added using ammonia. Compositions 22A and 22B were a bright yellow in color consistent with a characteristic color of hexavalent chrome. By way of contrast compositions 22 C and 22D, which include the reducing agent ascorbic acid, were a green-brown color consistent with a characteristic color of a predominantly trivalent chrome composition. Example 22E is a non-chrome based example prepared according to the present invention. This example is an embodiment wherein the inorganic portion includes at least one element from group IVB of the Periodic Table and at least one element from group VB of the Periodic Table. It includes as the organic polymer Avanse® MV100. Example 22A has a weight percentage of latex polymer active solids of 67% based on the total dry coating solids while it was 65% for example 22C and 65.9% for 22E. The weight percentage of group IVB element based on total dry coating solids for example 22A was 21.40%, for example 22C it was 20.50%, and for example 22E it was 20.80%.

TABLE 22

| Component | 22A | 22B | 22C | 22D | 22E |
|---|---|---|---|---|---|
| Deionized water | 45.05 | 57.20 | 44.20 | 56.70 | 44.50 |
| Bacote ® 20 | 28.15 | 0.00 | 28.15 | 0.00 | 28.15 |
| Ammonia (29% $NH_3$) | 0.00 | 4.85 | 0.00 | 4.85 | 0.00 |
| Chromium trioxide | 0.65 | 0.65 | 0.65 | 0.65 | 0.00 |
| $V_2O_5$ | 0.00 | 0.00 | 0.00 | 0.00 | 0.60 |
| Avanse ® MV 100 | 26.15 | 37.30 | 26.15 | 36.60 | 26.15 |
| Ascorbic acid | 0.00 | 0.00 | 0.85 | 1.20 | 0.60 |
| Total | 100.00 | 100.00 | 100.00 | 100.00 | 100.00 |
| % Total active solids | 19.50 | 19.50 | 20.30 | 20.30 | 20.00 |

As a comparative example 23 use was made of the commercial hexavalent chrome-based organic coating solution Passerite®3000B available from Henkel Corporation.

Figure 1B:
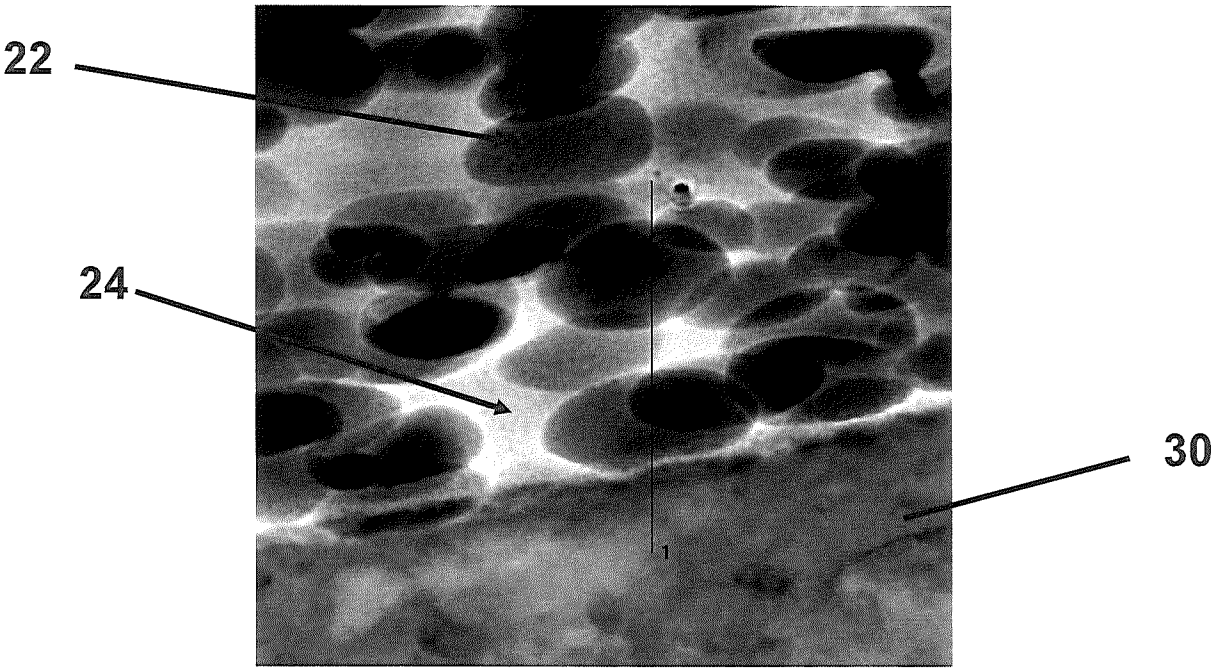
FIG. 1B is a higher magnification of the coating from FIG. 1A.

In example 24 coating composition 21A was applied to a cleaned aluminum panel by wire drawbar and dried to a PMT of 93° C. to provide a dry coating weight of 150±25 milligrams/square foot. The coated metal then had a thin layer of gold and a thin layer of platinum applied to it to facilitate cross-sectioning. Then it was cross-sectioned using a focused ion beam to produce a very thin slice of a cross-section of the coated substrate. The cross-section was then characterized by dark-field scanning transmission electron microscopy. The novel morphology of coating composition prepared according to the present invention is shown in the image obtained from this technique, shown in FIGS. 1A and 1B. In this technique the relative brightness vs. darkness of regions within the image reflect the composition with respect to average atomic number (Z) of the constituents. Light regions indicate the presence of constituents of higher average Z whereas darker regions are indicative of constituents of lower average Z. Energy Dispersive X-ray Analysis was performed to verify the elemental composition within these regions. The analysis showed that the continuous phase is an inorganic phase comprising chrome, zirconium, and oxygen. The technique involves transmission through a thin slice of dry coating which contains both continuous and dispersed material phases which differ significantly in average Z. As a result an image is provided with 3-dimensional aspect and reveals the novel morphology of the invention. After drying of the applied example 21A coating, residues from ammonium zirconium carbonate, Bacote® 20, contribute to bright regions. The acrylic latex polymer, which is largely based on carbon and oxygen, will be represented by darker regions. Polymer spheres which overlap at different depths within the slice result in the darkest regions of the image. As shown, one observes that the invention provides a coating with a continuous inorganic matrix within which discrete dispersed polymer spheres reside. The size of the discrete polymer spheres within the image is consistent with the particle size measurement for the acrylic latex from example 21. Elongation of polymer spheres is attributed to the effects of shrinkage during drying of the composite structure. Looking to FIG. 1A the platinum/gold cap is seen at 10, the coating composition 21A is shown at 20 with the dispersed polymer spheres shown at 22 and the continuous inorganic phase shown at 24. The substrate aluminum is shown at 30. FIG. 1B is a higher magnification of a region of FIG. 1A and clearly shows the continuous inorganic phase 24 and the dispersed polymer spheres 22. Clearly, unlike the expected in the present invention the polymer latex does not coalesce and instead stays as a dispersed phase in the continuous inorganic phase.

Figure 2A:
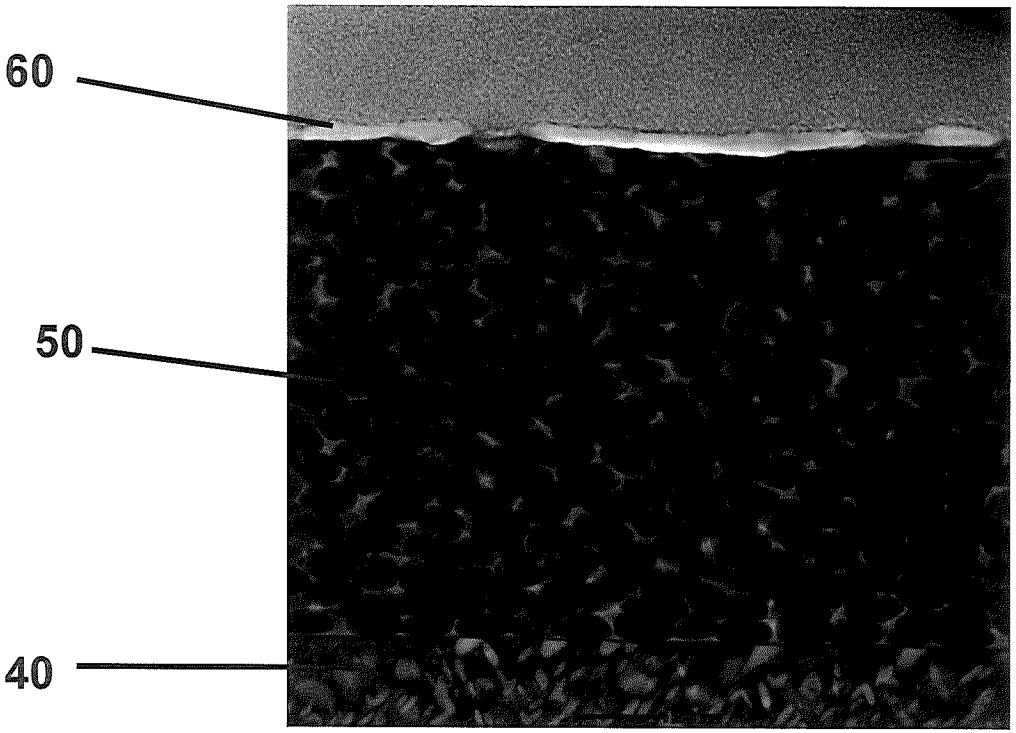
FIG. 2A is a photograph from a Dark-Field Scanning Transmission Electron Microscopy of a non-chrome coating prepared according to the present invention.
Figure 2B:
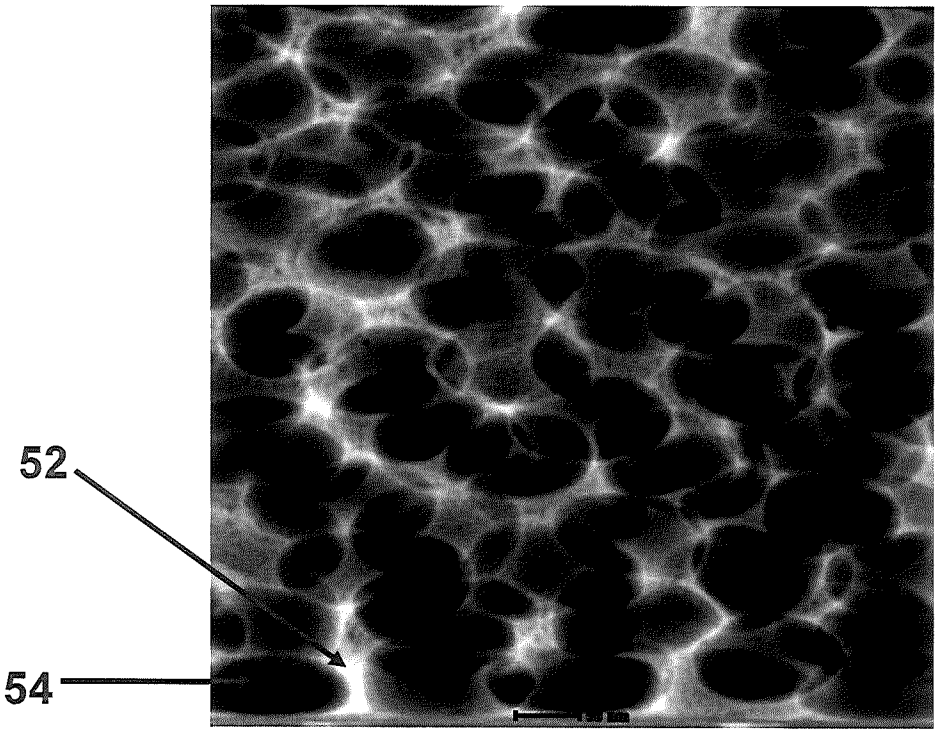
FIG. 2B is a higher magnification of the coating from FIG. 2A.

In example 25 composition 22E, a non-chrome example of the present invention, was applied to a cleaned Galvalume® panel by wire drawbar and dried to a PMT of 93° C. to provide a dry coating weight of 200±25 milligrams/square foot. The coated metal was cross-sectioned by focused ion beam to produce a thin slice which was characterized by dark-field scanning transmission electron microscopy as described in example 24. The novel characteristic morphology of the invention, a continuous inorganic phase with largely discrete dispersed polymer phase, is demonstrated. Energy Dispersive X-ray Analysis was performed to verify the elemental composition within the continuous and dispersed phases. Again the continuous phase was inorganic and comprised zirconium, vanadium, and oxygen. The size of the observed polymer spheres within the coating 22E is consistent with the particle size measurements made for the latex used in the example 22E formulation. Relative to example 24, one observes a higher density of polymer spheres within the coating which is consistent with the difference in acrylic content of example 21A and example 22E formulations. The results are shown in FIGS. 2A and 2B, which is a higher magnification of a region shown in FIG. 2A. The platinum/gold cap is seen at 60, the coating composition 50 includes polymer spheres 54 and the continuous inorganic phase 52, and the substrate is shown at 40.

Figure 3:
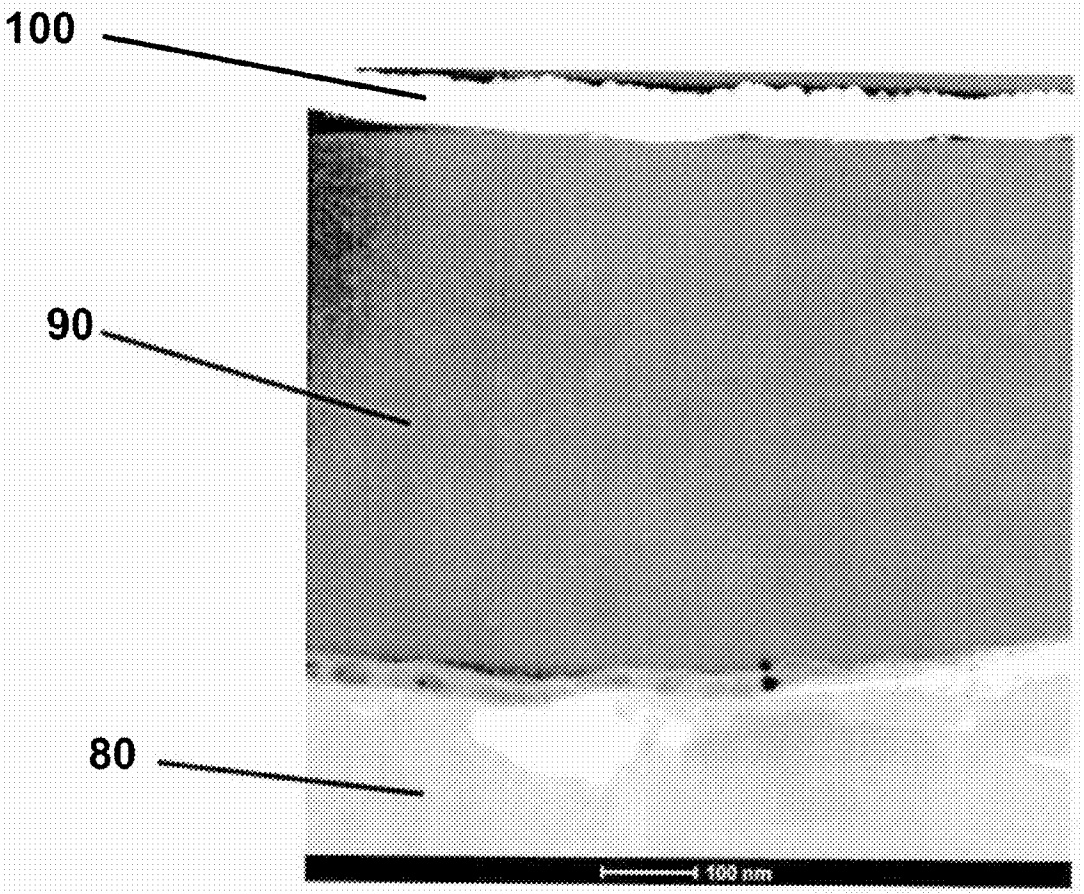
Figure 3 (PRIOR ART)
FIG. 3 is a photograph from a Dark-Field Scanning Transmission Electron Microscopy of a conventional commercial chrome-based coating not prepared according to the present invention.

In example 26 comparative example 23 was applied to a cleaned aluminum panel by wire drawbar and dried to a PMT of 93° C. to provide a dry coating weight of 150±25 milligrams/square foot. The coated metal was cross-sectioned by focused ion beam to produce a thin slice which was characterized by dark-field scanning transmission electron microscopy as described in example 24. The image obtained from this technique illustrates that the novel morphology of the coatings prepared according to the present invention is not present in a commercial chrome-based coating. What is observed is a film comprising a continuous organic phase resulting from coalesced polymer characteristic of conventional polymer coatings. Energy Dispersive X-ray Analysis was performed to verify the elemental composition within the continuous phase. In FIG. 3 the substrate is seen at 80, the coalesced polymer at 90 and the platinum/gold cap at 100.

As discussed above, one of the disadvantages of current chrome-based coating compositions is the tendency of the chrome to leach out of the coating composition after it is applied to a substrate. Thus, the leaching of the examples in accordance with the present invention was compared to the comparative samples in example 27. In example 27, each of the chrome-containing coating compositions from Examples 21 and 22 were applied to clean Hot dipped Galvanized Steel (HDG) and Galvalume® panels by wire drawbar and dried to a PMT of 93° C. Dry coating weights on HDG panels were 175±25 milligrams/square foot. Dry coating weights on Galvalume® panels were 150±25 milligrams/square foot. After coating, the panels were subjected a test protocol to characterize the tendency of each to leach chrome with water exposure. Panels were immersed in 1.5 liters of warm deionized water at 50° C. for 30 seconds after which they were rinsed for 30 seconds with cold water and dried. Chrome content of the coated panels was determined before and after subjecting panels to the test protocol using a Portspec X-ray spectrograph model 2501 manufactured by Cianflone Scientific Instruments Corporation. The difference in chrome content following the immersion protocol was calculated. Ratings for the percentage of chrome loss were assigned a number from 0 to 5 as follows: 0 is <5%; 1 is 5% to 19.99%; 2 is 20.00% to 39.99%; 3 is 40.00% to 59.99%; 4 is 60.00% to 79.99%; and 5 is 80.00% to 100.00%. The results are shown below in Table 28. The results show several significant trends. First, none of the coatings prepared according to the present invention showed significant leaching from either substrate. Second, virtually all of the comparative examples showed leaching from all substrates. Third, the predominantly trivalent chrome comparative examples showed significantly more leaching than the predominantly hexavalent comparative examples. Finally, all comparative compositions performed better on HDG compared to Galvalume®.

TABLE 28

| Example composition | Galvalume ® | HDG |
|---|---|---|
| 21A | 0 | 0 |
| 21B | 1 | 0 |
| 21C | 0 | 0 |
| 21D | 5 | 4 |
| 22A | 0 | 0 |
| 22B | 2 | 1 |
| 22C | 0 | 0 |
| 22D | 4 | 2 |

In example 29 compositions 21A, 21C and comparative commercial example 23 were applied to clean hot-dipped galvanized steel and Galvalume® panels by wire drawbar and dried to a PMT of 93° C. Dry coating weights achieved were 200±25 milligrams/square foot over HDG and 150±25 milligrams/square foot over Galvalume® panels. Then 3 replicate panels for each composition were placed in Neutral Salt Spray test according to ASTM-B117-07A and inspected at regular intervals. At each interval the corrosion was rated as % face rust. For the first 168 hours of salt spray exposure, ratings were made every 24 hours after which ratings were made at 168 hour intervals. The length of exposure time in hours at which % face-rust reached or exceeded limits of 10% and 25% were recorded for each of the three replicate panels. The average exposure times to reach or exceed the defined limits are summarized below in Table 29. The results clearly show that coating compositions prepared according to the present invention are significantly better than the tested commercial chrome-based coating composition. In addition, all perform significantly better on Galvalume® than on HDG.

TABLE 29

| Coating composition | Substrate | Hours to meet or exceed 10% face rust | Hours to meet or exceed 25% face rust |
|---|---|---|---|
| 21A | Galvalume ® | 3584 | 3864 |
| 21C | Galvalume ® | 2912 | 3360 |
| Comparative 23 | Galvalume ® | 2352 | 2576 |
| 21A | HDG | 1568 | 1848 |
| 21C | HDG | 1344 | 1680 |
| Comparative 23 | HDG | 672 | 784 |

In example 30, the coating compositions from example 22 were compared to comparative example 23. Examples 22A, 22C and comparative Example 23 were applied to clean hot-dipped galvanized steel and Galvalume® panels by wire drawbar and dried to a PMT of 93° C. Dry coating weights achieved were 200±25 milligrams/square foot over HDG and 150±25 milligrams/square foot over Galvalume® panels. Then 3 replicate panels for each composition were placed in Neutral Salt Spray and inspected at 168 hour intervals for the entire test period with the exception of two intervals which were 192 hours and 144 hours. At each interval the corrosion was rated as % face rust. The length of exposure time in hours at which % face-rust reached or exceeded a limit of 3% was recorded for each of the three replicate panels. The average exposure times are summarized below in Table 30. Again the present invention out performed the comparative example and all were better on Galvalume® than on HDG.

TABLE 30

| Coating composition | Substrate | Hours to meet or exceed 3% face rust |
|---|---|---|
| 22A | Galvalume ® | 1512 |
| 22B | Galvalume ® | 1080 |
| Comparative 23 | Galvalume ® | 1296 |
| 22A | HDG | 848 |
| 22C | HDG | 840 |
| Comparative 23 | HDG | 504 |

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A dried in place corrosion protective coating deposited on a metal substrate, said coating having a morphology comprising:

a continuous phase consisting of an inorganic phase, said inorganic phase consisting essentially of at least one element from group IVB of the Periodic Table present in an amount of from 9 to 73% by weight, based on total dry solids coating weight; and a discontinuous phase consisting of an organic phase, said organic phase consisting essentially of solids of one or more organic polymers, said one or more organic polymers present in an amount of from 1% to 75% by weight based on total dry solids coating weight and shaped as a plurality of discrete polymer spheres dispersed in the continuous inorganic phase, said spheres having an average particle size of from 111 to 137 nanometers and wherein said one or more organic polymers are selected from the group consisting of a polyvinyl dichloride resin, an acrylic-based resin, a methacrylate-based resin, a styrene-based resin, and a mixture thereof; and wherein said continuous phase optionally includes at least one element from group VB of the Periodic Table, and wherein said coating optionally includes a reducing agent for said at least one element from group VB.

2. The dried in place corrosion protective coating as claimed in claim 1, wherein the weight percentage of organic polymer solids based on the total dry solids coating weight is from 25% to 73% by weight.

3. The dried in place corrosion protective coating as claimed in claim 1, wherein the weight percentage of organic polymer solids based on the total dry solids coating weight is from 40% to 70% by weight.

4. The dried in place corrosion protective coating as claimed in claim 1 wherein said continuous phase further comprises at least one element from group VB of the Periodic Table.

5. The dried in place corrosion protective coating as claimed in claim 4, further comprising said reducing agent for said at least one element from group VB of the Periodic Table or a reaction product of said reducing agent.

6. The dried in place corrosion protective coating as claimed in claim 5 wherein said reducing agent comprises cysteine, ascorbic acid, $Sn^{2+}$, thiosuccinic acid, or a mixture thereof.

7. The dried in place corrosion protective coating as claimed in claim 4 wherein said at least one element from group VB of the Periodic Table comprises vanadium.

8. The dried in place corrosion protective coating as claimed in claim 1, wherein said at least one element from group IVB of the Periodic Table comprises zirconium.

9. A dried in place corrosion protective coating for metal substrates having a morphology comprising:

a continuous phase consisting of an inorganic phase comprising chrome present in an amount of from 1.66 to 2.96% by weight, based on total dry solids coating weight and at least one element from group IVB of the Periodic Table present in an amount of from 9 to 73% by weight, based on total dry solids coating weight; and a discontinuous phase consisting of an organic phase comprising solids of one or more organic polymers, said one or more organic polymers present in an amount of from 1% to 73% by weight, based on total dry solids coating weight and shaped as a plurality of discrete polymer spheres dispersed in the continuous inorganic phase, said spheres having an average particle size of from 111 to 137 nanometers, and wherein said one or more organic polymers are selected from the group consisting of polyvinyl dichloride resin, an acrylic-based resin, a methacrylate-based resin, a styrene-based resin, and a mixture thereof.

10. The dried in place corrosion protective coating as claimed in claim 9, wherein the weight percentage of organic polymer solids based on total dry solids coating weight is from 25% to 73% by weight.

11. The dried in place corrosion protective coating as claimed in claim 9, wherein the weight percentage of organic polymer solids based on total dry solids coating weight is from 40% to 70% by weight.

12. The dried in place corrosion protective coating as claimed in claim 9, further comprising a reducing agent or a reaction product thereof.

13. The dried in place corrosion protective coating as claimed in claim 12 wherein said reducing agent comprises cysteine, ascorbic acid, $Sn^{2+}$, thiosuccinic acid, or a mixture thereof.

14. The dried in place corrosion protective coating as claimed in claim 9, wherein said at least one element from group IVB of the Periodic table comprises zirconium.

15. A dried in place corrosion protective coating for metal substrates having a morphology comprising:

a continuous phase consisting of an inorganic phase comprising chromium trioxide present in an amount of from 3.2 to 5.7% by weight, based on total dry solids coating weight and at least one element from group IVB of the Periodic Table present in an amount of from 9 to 73% by weight, based on total dry solids coating weight; and a discontinuous phase consisting of an organic phase comprising solids of one or more organic polymers, said one or more organic polymers present in an amount of from 1% to 73% by weight, based on total dry solids coating weight and shaped as a plurality of discrete polymer spheres dispersed in the continuous inorganic phase, said spheres having an average particle size of from 111 to 137 nanometers, and wherein said one or more organic polymers are selected from the group consisting of polyvinyl dichloride resin, an acrylic-based resin, a methacrylate-based resin, a styrene-based resin, and a mixture thereof.

16. The dried in place corrosion protective coating as claimed in claim 15, wherein the weight percentage of organic polymer solids based on total dry solids coating weight is from 25% to 73% by weight.

17. The dried in place corrosion protective coating as claimed in claim 15, wherein the weight percentage of organic polymer solids based on total dry solids coating weight is from 40% to 70% by weight.

18. The dried in place corrosion protective coating as claimed in claim 15, further comprising a reducing agent or a reaction product thereof.

19. The dried in place corrosion protective coating as claimed in claim 18 wherein said reducing agent comprises cysteine, ascorbic acid, $Sn^{2+}$, thiosuccinic acid, or a mixture thereof.

20. The dried in place corrosion protective coating as claimed in claim 15, wherein said at least one element from group IVB of the Periodic Table comprises zirconium.

21. An aqueous corrosion protective conversion coating composition for metal substrates comprising:

an inorganic portion consisting essentially of deionized water, chrome present in an amount of from 1.66 to 2.96% by weight based on total dry solids coating weight and at least one element from group IVB of the Periodic Table present in an amount of from 9 to 73% by weight, based on total dry solids coating weight; and an organic portion comprising from 1% to 75% by weight, based on total dry solids coating weight, of solids of one or more organic polymers, wherein said one or more organic polymers are selected from the group consisting of a polyvinyl dichloride resin, an acrylic-based resin, a methacrylate-based resin, and a styrene-based resin, wherein said acrylic-based resin, said methacrylate-based resin, and said styrene-based resin are formed only from monomers selected from the group consisting of monomer, an acrylate, a methacrylate monomer, a styrene monomer, and a mixture thereof, and wherein said conversion coating composition has a pH of from about 6 to 11; and wherein said coating composition optionally includes a reducing agent.

22. A dried in place corrosion protective conversion coating for metal substrates comprising the corrosion protective conversion coating composition of claim 21 applied to a metal substrate and dried in place, said dried in place conversion coating having a morphology comprising:

a continuous phase consisting of an inorganic phase comprising said chrome present in an amount of from 1.66 to 2.96% by weight, based on total dry solids coating weight and said at least one element from group IVB of the Periodic Table present in an amount of from 9 to 73% by weight, based on total dry solids coating weight; and a discontinuous phase comprising an organic phase comprising solids of said one or more organic polymers, said one or more organic polymers present in an amount of from 1% to 73% by weight, based on total dry solids coating weight and shaped as a plurality of discrete polymer spheres dispersed in the continuous inorganic phase, said spheres having an average particle size of from 111 to 137 nanometers.

23. The aqueous corrosion protective conversion coating composition for metal substrates as claimed in claim 21, wherein the weight percentage of organic polymer solids based on total dry solids coating weight is from 25% to 73% by weight.

24. The aqueous corrosion protective conversion coating composition as claimed in claim 21, wherein the weight percentage of organic polymer solids based on total dry solids coating weight is from 40% to 70% by weight.

25. The aqueous corrosion protective conversion coating composition as claimed in claim 21, further comprising said reducing agent or a reaction product of said reducing agent.

26. The aqueous corrosion protective conversion coating composition as claimed in claim 25 wherein said reducing agent comprises cysteine, ascorbic acid, Sn2+, thiosuccinic acid, or a mixture thereof.

27. The aqueous corrosion protective conversion coating composition as claimed in claim 21 wherein said at least one element from group IVB of the Periodic Table comprises zirconium.

* * * * *